US007828086B2

(12) United States Patent
Lesko

(10) Patent No.: US 7,828,086 B2
(45) Date of Patent: Nov. 9, 2010

(54) GUIDE RAIL SYSTEM FOR A TELESCOPING MAST ON A DRILLING RIG

(76) Inventor: Gerald Lesko, 4807-68 Avenue, Edmonton, Alberta (CA) T6B 2N2

( * ) Notice: Subject to any disclaimer, the term of this patent is extended or adjusted under 35 U.S.C. 154(b) by 356 days.

(21) Appl. No.: 12/006,464

(22) Filed: Jan. 3, 2008

(65) Prior Publication Data

US 2008/0210416 A1 Sep. 4, 2008

(30) Foreign Application Priority Data

Jan. 4, 2007 (CA) ..... 2572758

(51) Int. Cl.
*E21B 15/00* (2006.01)

(52) U.S. Cl. ..... 175/203; 175/113; 175/162; 175/220; 166/77.1; 166/85.1

(58) Field of Classification Search ..... 166/77.1, 166/77.51, 85.1, 85.5, 241.1; 175/52, 113, 175/202, 203, 220, 162; 414/22.51, 22.68, 414/22.71

See application file for complete search history.

(56) References Cited

U.S. PATENT DOCUMENTS 6,112,834 A * 9/2000 Barrett ..... 175/162
6,412,576 B1 * 7/2002 Meiners ..... 175/57
2005/0194189 A1 * 9/2005 Barnes ..... 175/122

* cited by examiner

*Primary Examiner*—Jennifer H Gay
*Assistant Examiner*—Brad Harcourt
(74) *Attorney, Agent, or Firm*—J. Jay Haugen; Parlee McLaws LLP

(57) ABSTRACT

A guide track system for a tool that can be raised and lowered within a telescoping drilling rig tower is provided. The system includes parallel guide rails mounted on a fixed lower tower section and on a movable upper tower section of the drilling rig tower. The lower and upper guide rails are parallel to one another and overlap one another when the lower tower section is nested with the upper tower section. Guide wheels rotatably attached to the tool can have parallel grooves to roll on the guide rails. The grooves can have sidewalls that flare outward so that they do not scuff against the guide rails as the tool travels up and down within the tower.

15 Claims, 11 Drawing Sheets

GUIDE RAIL SYSTEM FOR A TELESCOPING MAST ON A DRILLING RIG

RELATED APPLICATIONS

The present application claims priority of Canadian Patent Application Serial No. 2,572,758 filed Jan. 4, 2007 and hereby incorporates the same Canadian Patent Application by reference.

TECHNICAL FIELD

The present invention is related to the field of telescoping drilling rig towers and a guide rail system for mounting thereon.

BACKGROUND

It is known to assemble drilling rig towers by providing a telescoping tower structure where an upper frame section or mast is raised within a lower frame section fixed to a drilling platform. Often, these sections are pyramid-shaped to provide rigidity and structural strength. In providing a telescoping tower in this configuration, it is not possible to place guide rails on the tower sections such that the rails on the lower section will align with rails on the upper section as the upper section is raised or lowered within the lower section so as to allow a top drive motor unit to travel within the tower along the guide rails.

SUMMARY

A guide rail system is provided for a telescoping drilling tower having guide rails mounted on the lower and upper tower sections whereby a tool, such as a top drive motor unit, can travel on the guide rails and be raised and lowered within the telescoping tower no matter where the upper tower section is positioned with respect to the lower tower section.

An embodiment of the guide rail system comprises a lower tower frame section that is operatively mounted on a drilling rig platform base and remains stationary. An upper tower section is slidably coupled to the lower tower section. In a representative embodiment, the upper tower section can be a parallelopiped structure and can be sized to slide inside the lower tower section, which also can be a parallelopiped structure, although one skilled in the art would understand that the upper tower section can alternatively be sized to slide on the outside of the lower tower section.

In one embodiment, the upper tower section is raised and lowered with respect to the lower tower section. One skilled in the art will appreciate that any of a variety of suitable mechanisms can be used to telescope the upper tower section. These mechanisms could include a motorized rack and pinion gear set or a cable and pulley mechanism. In one embodiment, hydraulic rams can be operatively coupled between the upper and lower tower sections to raise and lower the upper tower section using hydraulic control systems as well known to those skilled in the art.

On one side of each of the upper and lower tower sections, the guide rails can be placed on vertical frame members of the sections. The guide rails can be positioned such that they are facing or opposing one another and are substantially parallel. The guide rails can be welded to the tower sections or they can be attached to the tower sections using suitable fasteners as well known to those skilled in the art.

In another embodiment, the upper tower guide rails can be adjacent to at least a portion of the lower tower guide rails as well as being substantially parallel to them when the upper tower section is slidably coupled to the lower tower section.

In another embodiment, the guide rail system can further comprise at least one pair of guide wheels that are configured to be rotatably attached to the top drive unit, one wheel on each side of the top drive unit. The guide wheels can be integral to the top drive unit or they can be separate devices that can be attached to the top drive unit by welding, by fasteners or by using any of a variety of suitable arrangements as are well known to those skilled in the art.

In one embodiment, each guide wheel is adapted to roll on a guide rail on the tower sections thereby positioning the top drive unit between the vertical members within the tower sections bearing the guide rails. In a representative embodiment, the top drive unit can have two pairs of guide wheels adapted to roll on the guide rails, wherein two guide wheels can be vertically spaced apart on each side of the top drive unit. This arrangement can steady the top drive unit within the tower sections and can keep it from pitching forwards and backwards or from rocking side to side as the top drive unit is raised or lowered within the drilling rig tower. The guide wheels can be adapted to have two parallel grooves where one groove rolls on the lower tower section guide rails and whereas the other groove rolls on the upper tower section guide rails as the top drive unit is raised within the drilling rig tower from the lower tower section to the upper tower section.

In a representative embodiment, the guide rails are rectangular or square tubing having rounded outside corners. The grooves on the guide wheels are adapted to roll on the tubing and have flat bottom surfaces and rounded corners on the bottom of the grooves to correspond to the rolling surface of the guide rail tubing. The side walls of the guide wheel grooves flare outwards such that these side walls do not touch or scuff against the side walls of the guide rail tubing as the guide wheels roll up and down the guide rails. In this manner, the guide rail groove can be centered on the guide rail as the rounded corners of the groove ride on the rounded corners of the guide rail tubing yet the groove side walls do not drag against the tubing side walls allowing the top drive unit to ride smoothly and securely on the guide rails.

Broadly stated, a guide rail system is provided for a tool configured to be raised and lowered within a telescoping tower structure having a stationary lower tower section and an upper tower section slidably coupled to said lower tower section, said upper tower section configured to be raised and lowered with respect to said lower tower section, the system comprising: a pair of opposing first guide rails configured to be disposed on said lower tower section, said first guide rails substantially parallel and facing each other; a pair of opposing second guide rails configured to be disposed on said upper tower section, said second guide rails substantially parallel and facing each other, said second guide rails adjacent and substantially parallel to at least a portion of said first guide rails when said upper tower section is slidably coupled to said lower tower section; and at least one pair of guide wheels configured to be rotatably coupled to said tool, one of said at least one pair of guide wheels adapted to roll on one of said first opposing guide rails, the other of said at least one pair of guide wheels adapted to roll on the other of said first opposing guide rails whereby said guide wheels roll on said first guide rails as said tool is raised within said lower tower section, said guide wheels further adapted to roll on said second opposing guide rails when said tool is raised from said lower tower section to said upper tower section within said tower structure.

Broadly stated, a telescoping drilling rig tower is provided for a tool configured to be raised or lowered within said tower, comprising: a lower tower section adapted for stationary mounting on a rig mounting base; an upper tower section slidably coupled to said lower tower section; means for raising and lowering said upper tower section with respect to said lower tower section; a pair of opposing first guide rails disposed on said lower tower section, said first guide rails substantially parallel and facing each other; and a pair of opposing second guide rails disposed on upper tower section, said second guide rails substantially parallel and facing each other, said second guide rails adjacent and substantially parallel to at least a portion of said first guide rails when said upper tower section is slidably coupled to said lower tower section.

DETAILED DESCRIPTION

Figure 1:
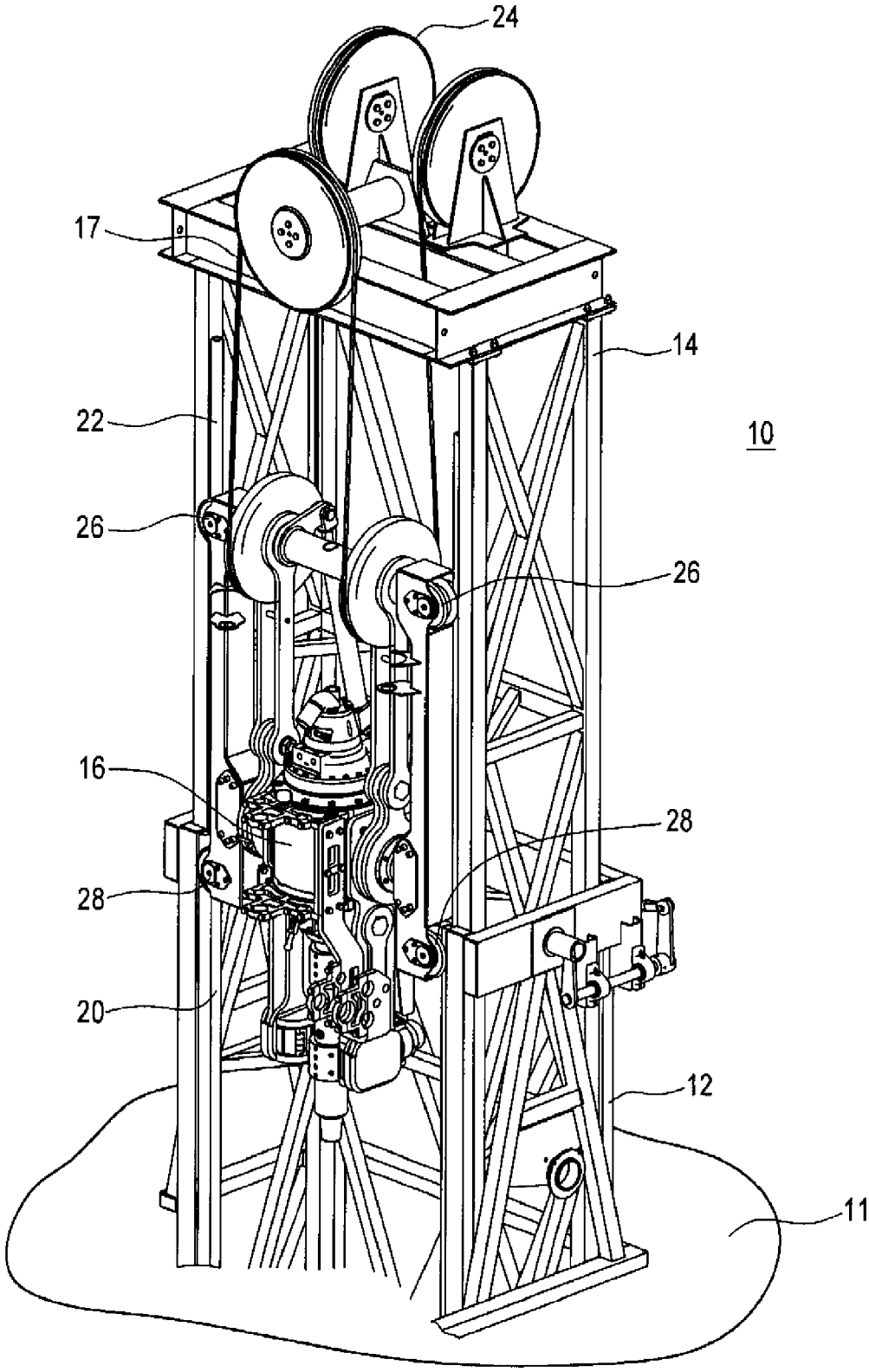
FIG. 1 is a perspective view depicting a telescoping rig tower having a top drive unit wherein the upper and lower rig tower sections are shown in a collapsed configuration.

Illustrated in FIG. 1 is an embodiment of a guide rail system for a telescoping drilling rig tower. This embodiment comprises rig tower 10 having lower tower section 12 that can be mounted on top of rig platform 11. Rig platform 11 may be part of a stationary drilling rig or part of a portable drilling rig structure mounted on a vehicle such as a flat-bed truck adapted for such use, as well known to those skilled in the art. In this FIG. 1, upper tower section 14 is shown fully nested in lower tower section 12. Upper tower section 14 can be slidably coupled to lower tower section 12. In one embodiment, lower tower section 12 and upper tower section 14 can be parallelopiped structures. In a representative embodiment, upper tower section 14 can slide within lower tower section 12 in a telescoping fashion although it would be apparent to those skilled in the art that upper tower section 14 can be sized to slide on the outside of lower tower section 12.

In another embodiment, mounted within tower 10 is a tool such as top drive unit 16 that is supported by cable 17 that, in turn, rolls over the pulleys in king block 24 to a cable drawworks mechanism (not shown). Upper tower section 14 can be raised or lowered with respect to lower tower section 12 using a mechanism such as a rack and pinion gear set, cable and pulley system or a hydraulic ram system. In a representative embodiment, hydraulic rams (not shown) coupled between tower sections 12 and 14 can alternatively be provided to raise or lower upper tower section 14 with respect to lower tower section 12 as well known to those skilled in the art.

Figure 2:
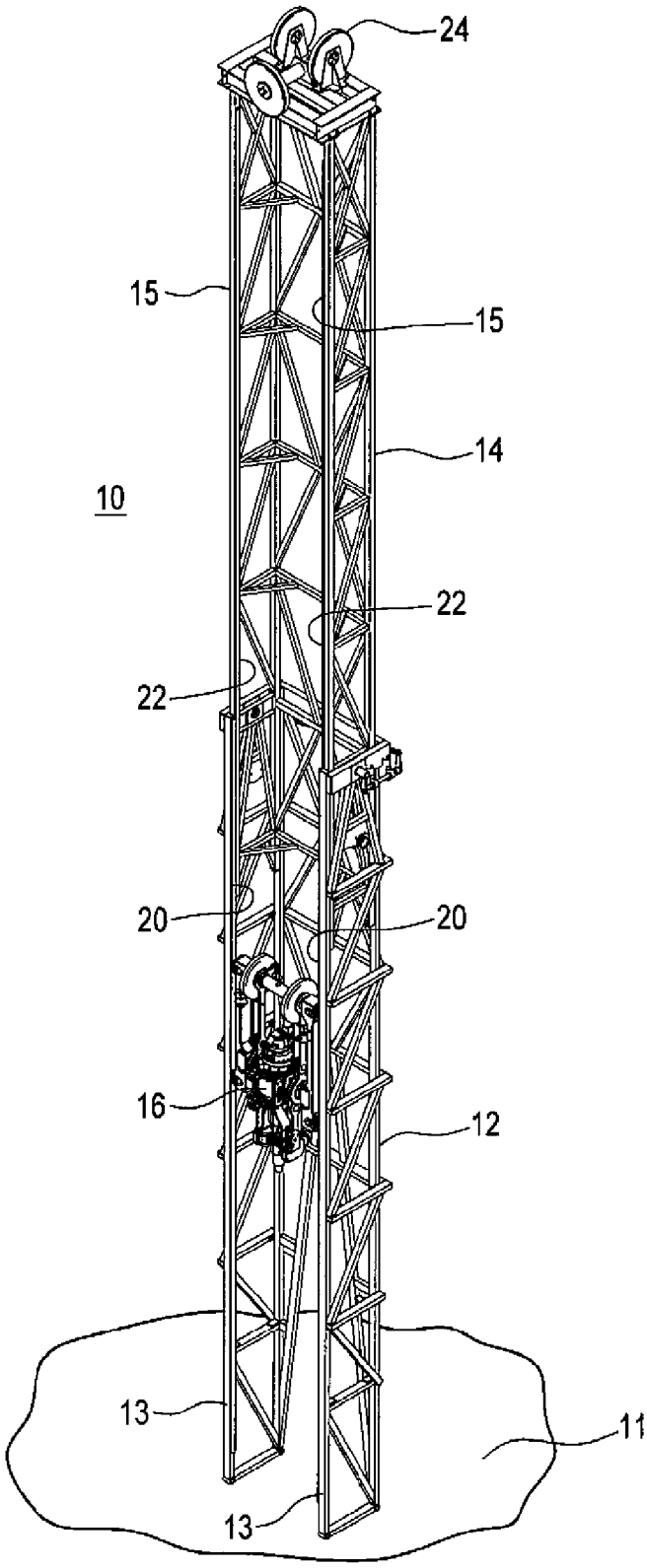
FIG. 2 is perspective view depicting the rig tower of FIG. 1 in an extended configuration with the top drive unit positioned in the lower rig tower section.
Figure 3:
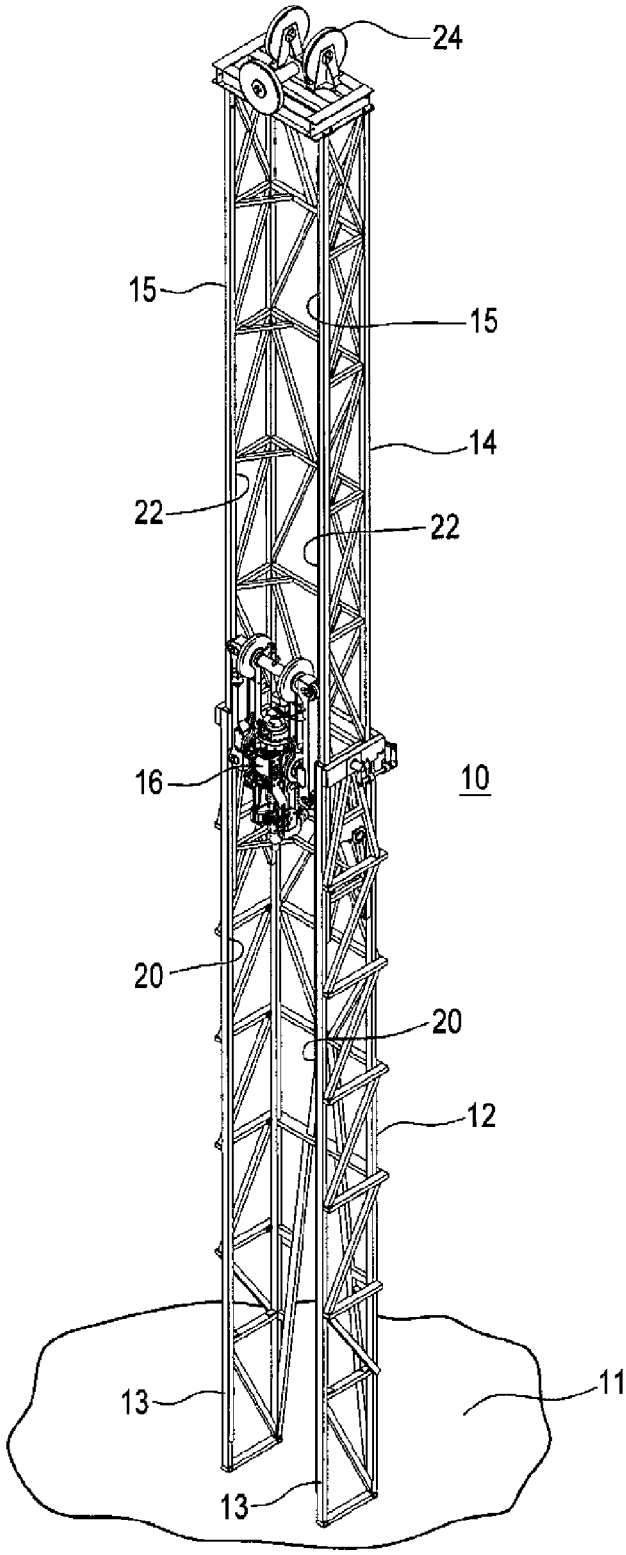
FIG. 3 is perspective view depicting the rig tower of FIG. 1 in an extended configuration with the top drive unit positioned where the upper and lower rig tower sections overlap.
Figure 4:
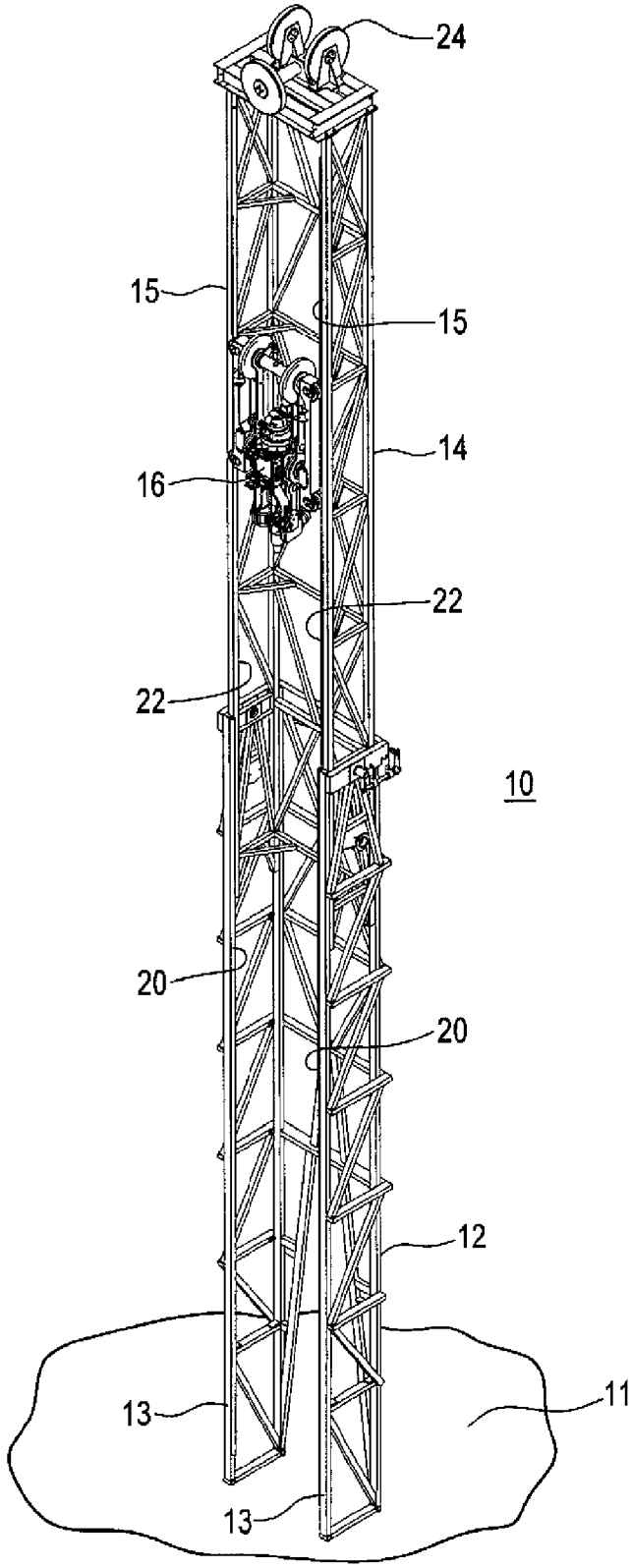
FIG. 4 is perspective view depicting the rig tower of FIG. 1 in an extended configuration with the top drive unit positioned in the upper rig tower section.

Referring to FIGS. 2, 3 and 4, top drive unit 16 is shown in a lower position, in a halfway position and in an upper position, respectively, within tower 10.

Figure 5:
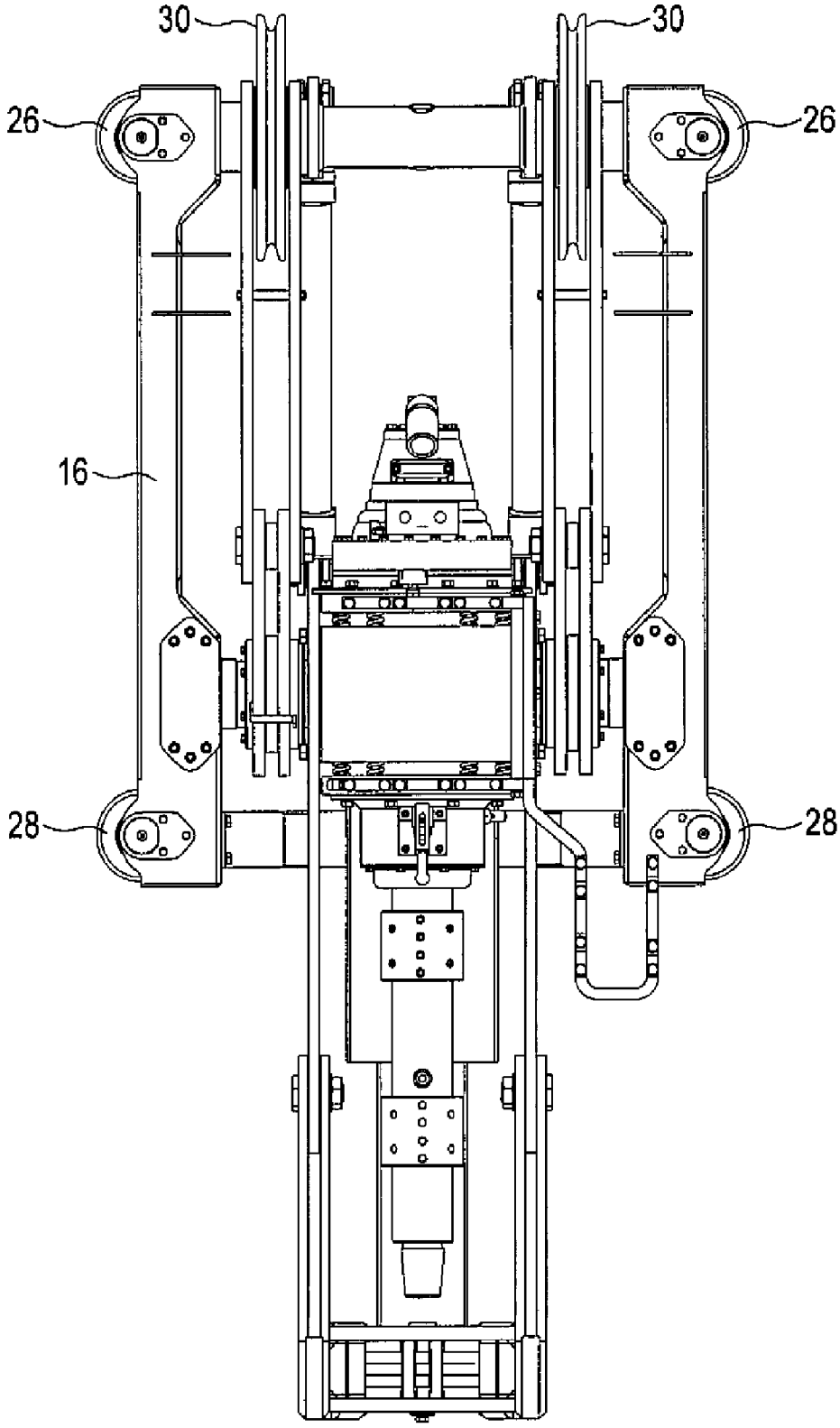
FIG. 5 is a front elevational view depicting the top drive unit of FIG. 1.
Figure 6:
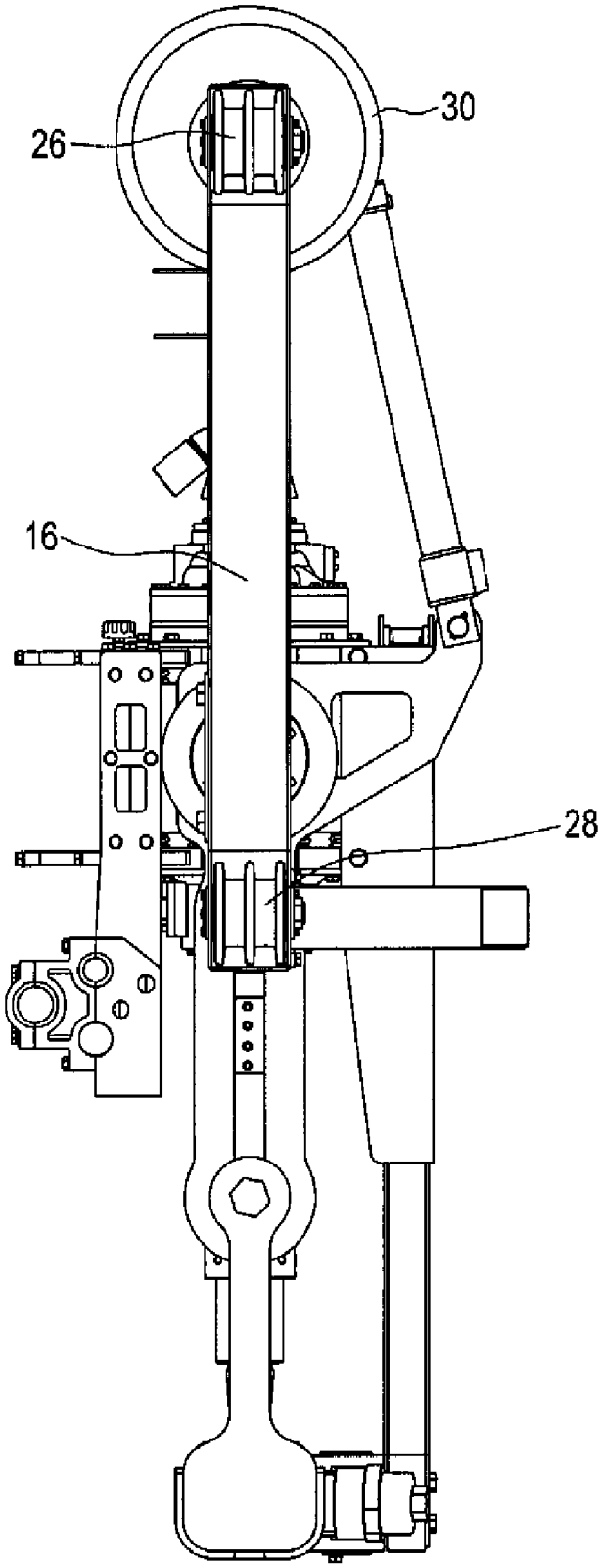
FIG. 6 is a side elevational view depicting the top drive unit of FIG. 1.
Figure 7:
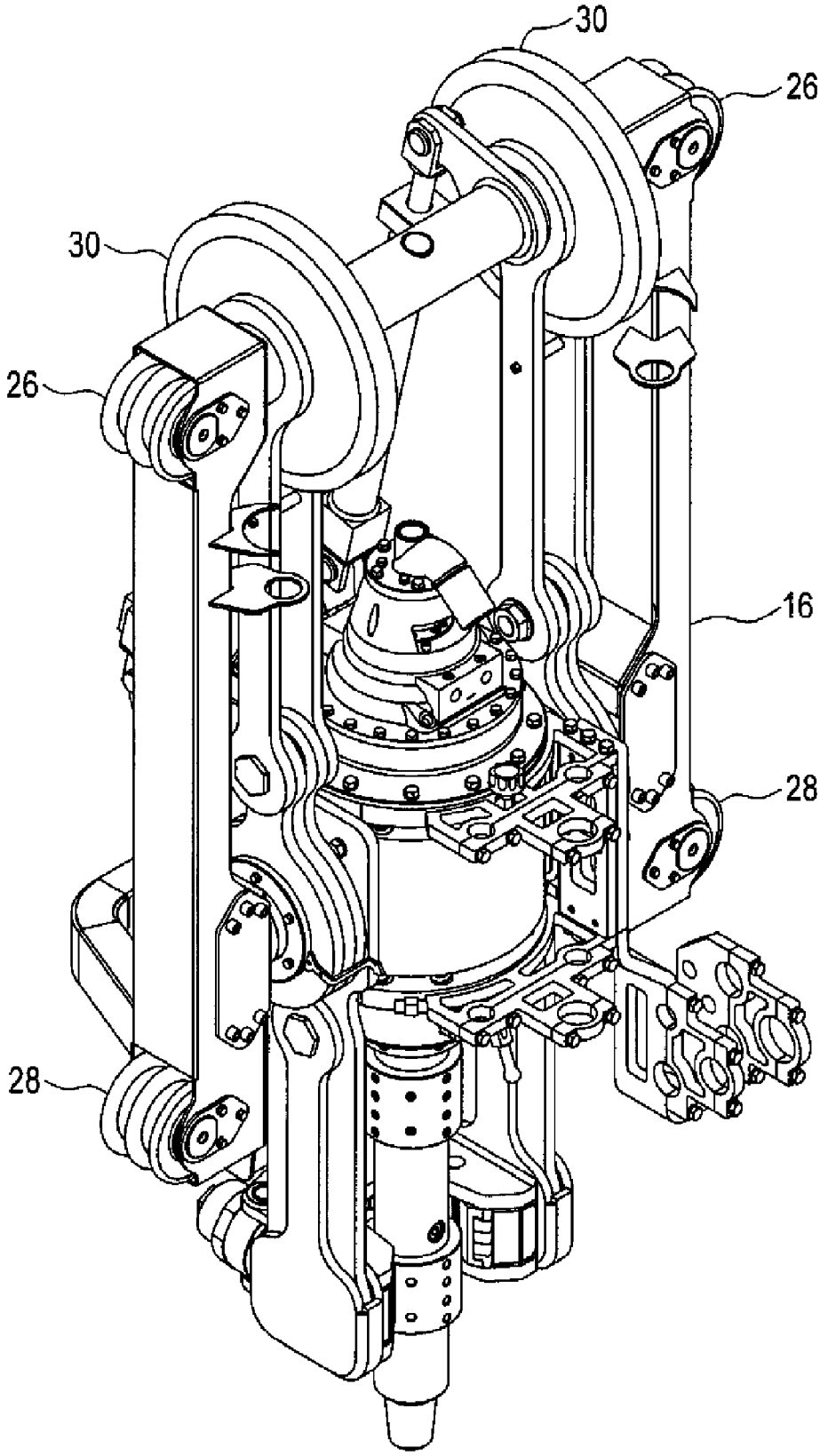
FIG. 7 is perspective view depicting the top drive unit of FIG. 1.

Referring to FIGS. 5, 6 and 7, top drive unit 16 is shown having upper guide wheels 26 and lower guide wheels 28, one of each mounted on each side of top drive unit 16. Guide wheels 26 and 28 are vertically spaced-apart so as to provide stability to top drive unit 16 as it travels within tower 10 as discussed in further detail below.

Figure 8:
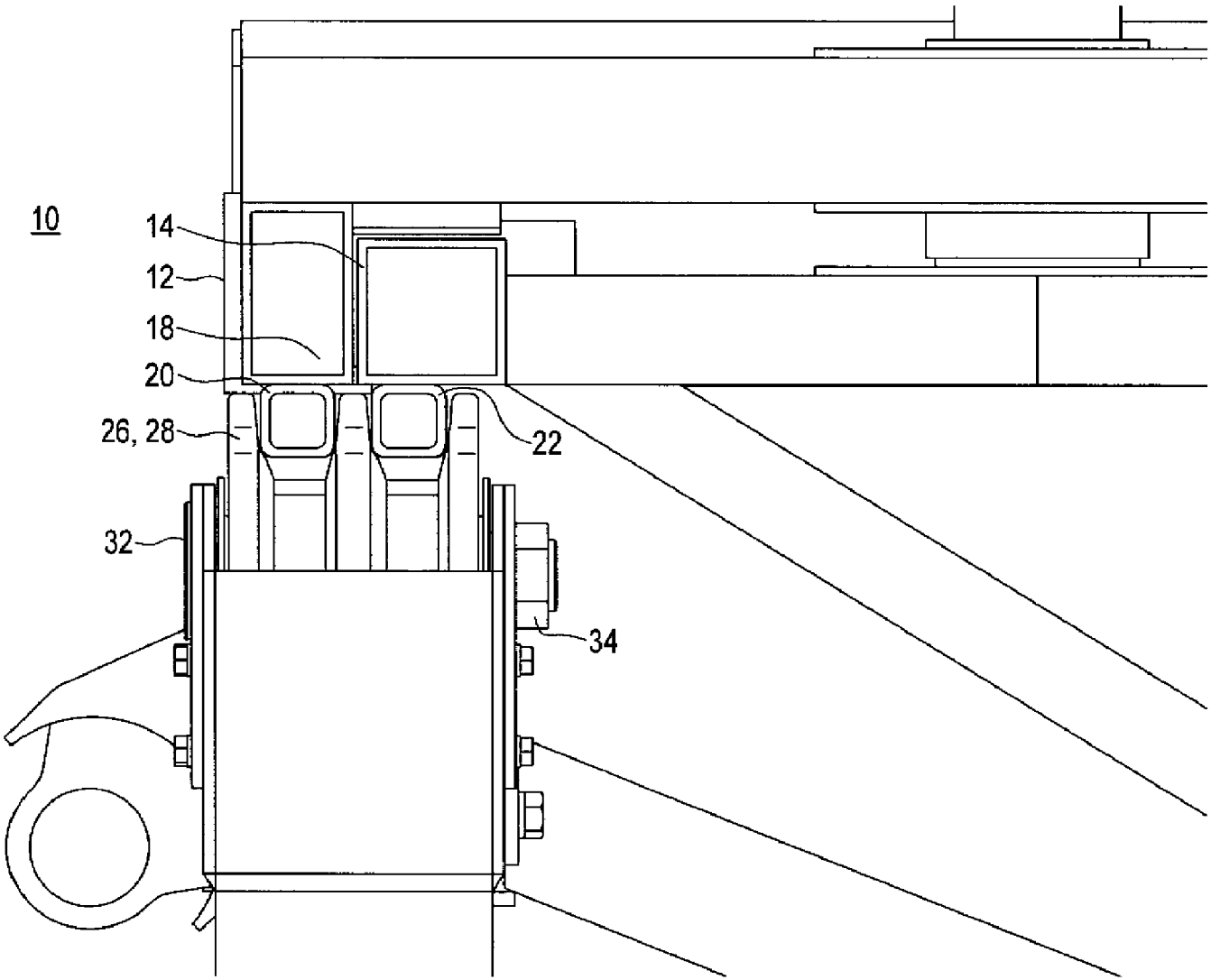
FIG. 8 is a top plan view depicting the guide rail components of the rig tower of FIG. 1.
Figure 9:
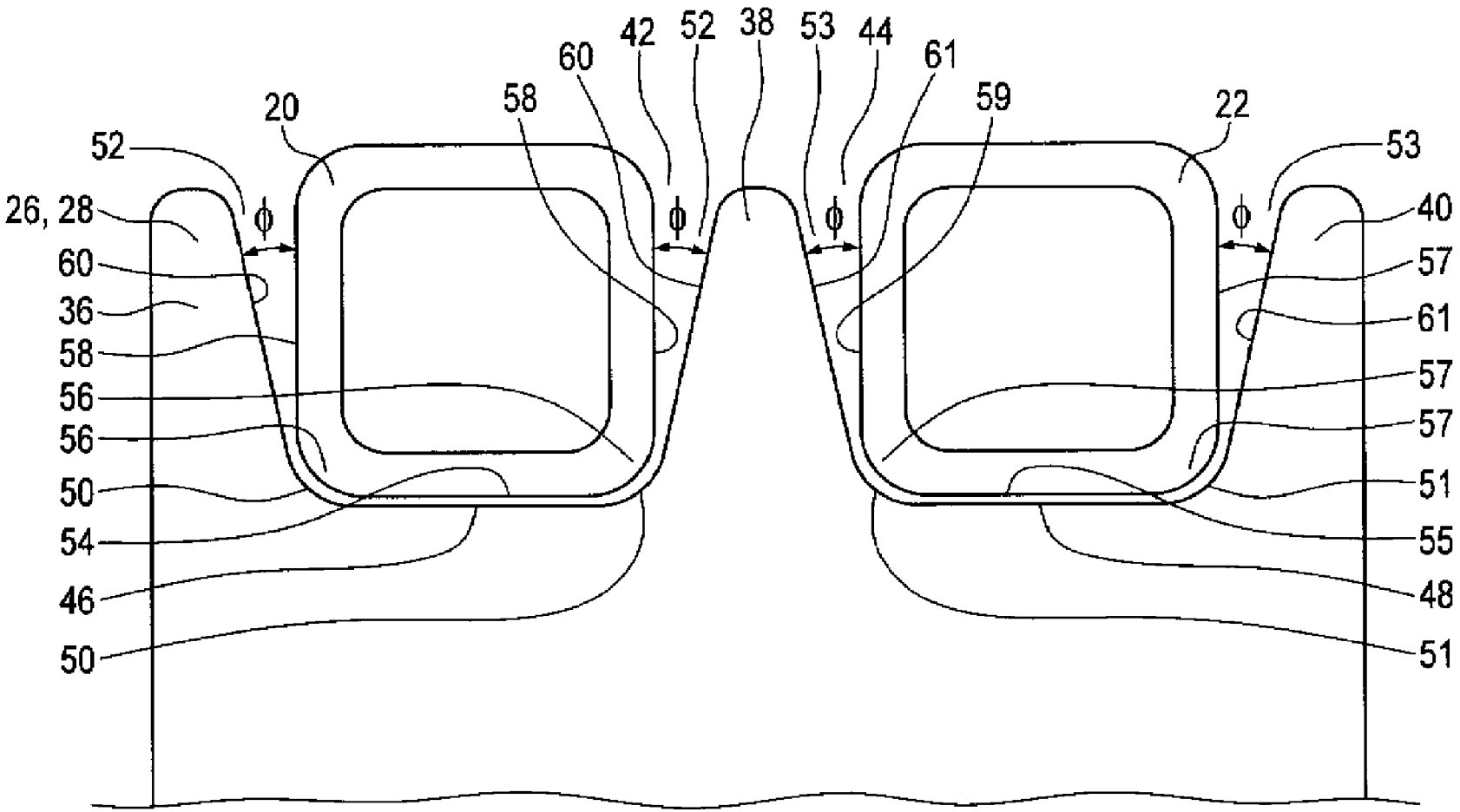
FIG. 9 is a close up top plan view depicting the guide rail components of FIG. 8.

Referring to FIGS. 8 and 9, guide wheels 26 and 28 can roll on guide track 18 that includes upper guide rails 22 mounted on vertical frame members (see 15 in FIG. 2) of upper tower section 14, and lower guide rails 20 mounted on vertical frame members (see 13 in FIG. 2) of lower tower section 12. Both sets of guide rails 20 and 22 are parallel to one another and oppose or face one another within tower 10. When upper tower section 14 is slidably coupled to lower tower section 12, upper guide rails 22 overlap lower guide rails 20 such that the guide rails are adjacent to at least a portion of each other and are parallel to one another as to form a continuous guide track 18 along the height of tower 10. Guide rails 20 and 22 can be welded to the tower sections or can be attached to the tower sections using suitable fasteners as known to those skilled in the art.

In one embodiment, guide wheels 26 and 28 can have parallel grooves 42 and 44 in a side-by-side arrangement. Groove 42 rolls on lower guide rail 20 whereas groove 44 rolls on upper guide rail 22. When upper and lower tower sections 14 and 12 overlap, guide wheels 26 and 28 are positioned on guide track 18 such that guide wheels 26 and 28 roll on both lower and upper guide rails 20 and 22. With this arrangement, guide rails 26 and 28 smoothly roll from guide rails 20 to guide rails 22 as top drive unit 16 is raised from lower tower section 12 to upper tower section 14.

Referring to FIG. 9, a detailed top view of a representative embodiment of the guide rail system is shown. As described above, each guide wheel 26 and 28 has grooves 42 and 44 that are adapted to roll on guide rails 20 and 22. In one embodiment, both guide rails 20 and 22 can be rectangular in cross-section. In a representative embodiment, guide rails 20 and 22 are square in cross-section. Grooves 42 and 44 are formed between sidewall 36, center ridge 38 and sidewall 40 on guide wheels 26 and 28. Groove 42 can have groove sidewalls 60, groove base 46 and base corners 50. Groove 44 can have groove sidewalls 61, groove base 48 and base corners 51. Groove bases 46 and 48 correspond to guide rail faces 54 and 55 of guide rails 20 and 22. Base corners 50 and 51 can be rounded and adapted to roll smoothly on guide rail corners 56 and 57 of guide rails 20 and 22 with little or no side-to-side movement of guide rails 20 and 22 within grooves 42 and 44.

In another embodiment, groove sidewalls 60 and 61 can flare outwardly in each of grooves 42 and 44 at angles 52 and 53. By angling sidewalls 60 and 61 in this manner, there is clearance between groove sidewalls 60 and 61 and guide rail sidewalls 58 and 59 such that groove sidewalls 60 and 61 will not scuff against guide rail sidewalls 58 and 59 as guide wheels 26 and 28 roll on guide track 18. In a representative embodiment, angles 52 and 53 can be in the range of 1° to 10°.

Figure 10:
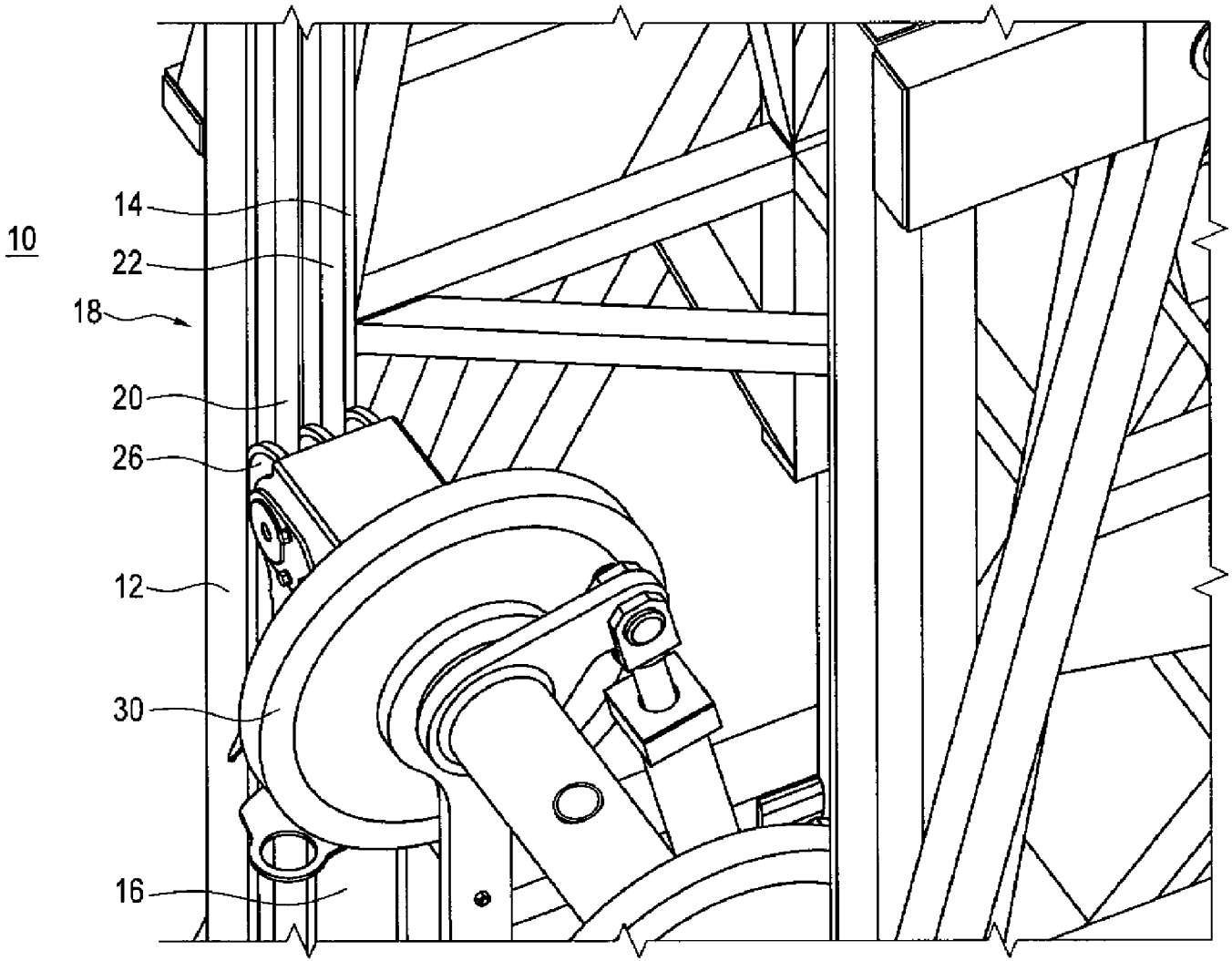
FIG. 10 is a perspective view depicting the guide rail components of the rig tower of FIG. 2.
Figure 11:
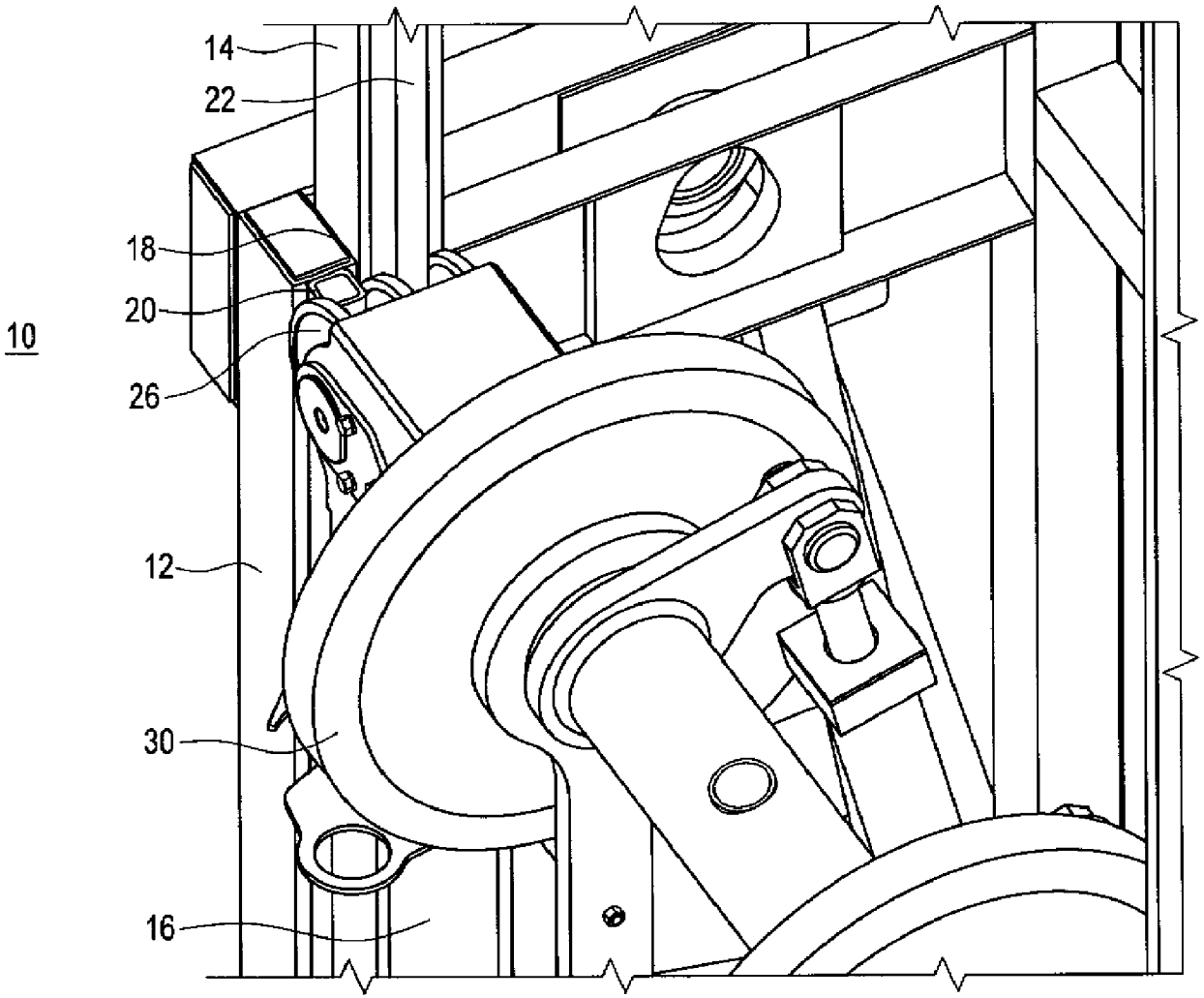
FIG. 11 is a perspective view depicting the guide rail components of FIG. 10 when the top drive unit is positioned where the upper and lower rig tower sections overlap.

Referring to FIGS. 10 and 11, top drive unit 16 is shown being raised in tower 10 from lower tower section 12 (FIG. 10) to upper tower section 14 (FIG. 11). Guide wheels 26 and 28 roll on both guide rails 20 and 22 where upper tower section 14 overlaps lower tower section 12. As guide wheels 26 and 28 roll up guide track 18, groove 42 rolls off of guide rail 22 thereby leaving groove 44 rolling on guide rail 22 by itself. As shown in FIGS. 5, 6 and 7, guide wheels 26 and 28 are vertically spaced apart on top drive 16 to provide stability to top drive unit 16 and keep it from pitching forwards or backwards or rocking side-to-side as it travels on guide track 18 within tower 10.

Although a few embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the scope of the invention is defined and limited only by the claims that follow.

What is claimed is:

1. A guide rail system for a tool configured to be raised and lowered within a telescoping tower structure having a stationary lower tower section and an upper tower section slidably coupled to said lower tower section, said upper tower section configured to be raised and lowered with respect to said lower tower section the system comprising:

a) a pair of opposing first guide rails configured to be disposed on said lower tower section, said first guide rails substantially parallel and facing each other, said first guide rails further comprised of tubing, said tubing comprising rounded outside corners;

b) a pair of opposing second guide rails configured to be disposed on said upper tower section, said second guide rails substantially parallel and facing each other, said second guide rails adjacent and substantially parallel to at least a portion of said first guide rails when said upper tower section is slidably coupled to said lower tower section; and c) at least one pair of guide wheels configured to be rotatably coupled to said tool, one of said at least one pair of guide wheels adapted to roll on one of said first opposing guide rails, the other of said at least one pair of guide wheels adapted to roll on the other of said first opposing guide rails whereby said guide wheels roll on said first guide rails as said tool is raised within said lower tower section said guide wheels further adapted to roll on said second opposing guide rails when said tool is raised from said lower tower section to said upper tower section within said tower structure, said guide wheels further comprising grooves configured to substantially contact said rounded outside corners of said tubing and to roll on said tubing, said guide wheels further comprising sidewalls that are configured not to contact said tubing as said guide wheels roll on said tubing.

2. The system as set forth in claim 1 wherein said tool comprises a top drive unit.

3. The system as set forth in claim 1 wherein said tubing comprises rectangular tubing.

4. The system as set forth in claim 1 wherein said system comprises two pairs of opposing guide wheels configured to be rotatably coupled to said tool.

5. The system as set forth in claim 1 wherein said upper tower section is adapted to slide up and down inside said lower tower section.

6. The system as set forth in claim 1 wherein said upper tower section is adapted to slide up and down outside said lower tower section.

7. The system as set forth in claim 1, wherein said sidewalls on said guide wheels flare outwardly.

8. A telescoping drilling rig tower for a tool configured to be raised or lowered within said tower, comprising:

a) a lower tower section adapted for stationary mounting on a rig mounting base;

b) an upper tower section slidably coupled to said lower tower section;

c) means for raising and lowering said upper tower section with respect to said lower tower section;

d) a pair of opposing first guide rails disposed on said lower tower section, said first guide rails substantially parallel and facing each other;

e) a pair of opposing second guide rails disposed on upper tower section, said second guide rails substantially parallel and facing each other, said second guide rails adjacent and substantially parallel to at least a portion of said first guide rails when said upper tower section is slidably coupled to said lower tower section;

f) said first and second guide rails comprised of tubing, said tubing comprising rounded outside corners; and g) at least one pair of guide wheels configured to be rotatably coupled to said tool one of said at least one pair of guide wheels adapted to roll on one of said first opposing guide rails, the other of said at least one pair of guide wheels adapted to roll on the other of said first opposing guide rails whereby said guide wheels roll on said first guide rails as said tool is raised within said lower tower section, said guide wheels further adapted to roll on said second opposing guide rails when said tool is raised from said lower tower section to said upper tower section within said drilling rig tower, said guide wheels further comprising grooves configured to substantially contact said rounded outside corners of said tubing and to roll on said tubing, said guide wheels further comprising sidewalls that are configured not to contact said tubing as said guide wheels roll on said tubing.

9. The tower as set forth in claim 8 wherein said tool comprises a top drive unit.

10. The tower as set forth in claim 8 wherein said tubing comprises rectangular tubing.

11. The tower as set forth in claim 8 further comprising two pairs of guide wheels configured to be rotatably coupled to said tool.

12. The tower as set forth in claim 8 wherein said upper tower section is adapted to slide up and down inside said lower tower section.

13. The tower as set forth in claim 8 wherein said upper tower section is adapted to slide up an down outside said lower tower section.

14. The tower as set forth in claim 8 wherein said means for raising and lowering said upper tower section is selected from the group consisting of motorized rack and pinion mechanisms, cable and pulley mechanisms, and hydraulic ram mechanisms.

15. The tower as set forth in claim 8, wherein said sidewalls on said guide wheels flare outwardly.

* * * * *

UNITED STATES PATENT AND TRADEMARK OFFICE

CERTIFICATE OF CORRECTION

PATENT NO. : 7,828,086 B2
APPLICATION NO. : 12/006464
DATED : November 9, 2010
INVENTOR(S) : Gerald Lesko It is certified that error appears in the above-identified patent and that said Letters Patent is hereby corrected as shown below:

Claim 1, column 5, line 26, change “section the” to --section, the--.

Claim 1, column 5, line 46, change “section said” to --section, said--.

Claim 8, column 6, line 26, change “tool one” to --tool, one--.

Claim 13, column 6, line 52, change “an down” to --and down--.

Signed and Sealed this
Twenty-second Day of February, 2011

David J. Kappos

David J. Kappos
*Director of the United States Patent and Trademark Office*